United States Patent [19]

Ling

[11] Patent Number: 4,896,517

[45] Date of Patent: Jan. 30, 1990

[54] WIRE LOCK HAVING SELF-RETRACTABLE WIRE

[76] Inventor: Chong-Kuan Ling, c/o Sinox Co., Ltd., P.O. Box 53-58, Taipei, Taiwan

[21] Appl. No.: 379,922

[22] Filed: Jul. 14, 1989

[51] Int. Cl.[4] ..... E05B 37/02

[52] U.S. Cl. ..... 70/18; 70/30; 70/233

[58] Field of Search ..... 70/18, 30, 49, 233; 114/254

[56] References Cited

U.S. PATENT DOCUMENTS

| | | | |
|---|---|---|---|
| 3,906,758 | 9/1975 | Hurwitt | 70/30 |
| 4,543,806 | 10/1985 | Papandrea et al. | 70/30 |
| 4,610,152 | 9/1986 | Duringer | 70/30 |
| 4,665,724 | 5/1987 | Sakai | 70/30 |
| 4,756,171 | 7/1988 | Homar | 70/18 |

FOREIGN PATENT DOCUMENTS

| | | | |
|---|---|---|---|
| 142959 | 1/1931 | Switzerland | 70/49 |

*Primary Examiner*—Lloyd A. Gall

[57] ABSTRACT

A wire lock includes a push-button latch operatively locking a locking head of a wire rope wound in a lock casing, and operatively depressed for disengaging the locking head of the wire rope when opening the lock so that the wire rope can be automatically retracted into the lock casing. The locking head of the wire rope may be depressed to disengage a plurality of sleeves from dials of the wire lock for conveniently resetting a new combination for the lock.

12 Claims, 2 Drawing Sheets

WIRE LOCK HAVING SELF-RETRACTABLE WIRE

BACKGROUND OF THE INVENTION

Tadashi Sakai disclosed a wire lock in his U.S. Pat. No. 4,665,724 comprising a take-up unit enclosed a locking wire therein which can be drawn out against the biasing force of a spring and rewound by the biasing force. However, it has the following drawbacks:

1. When the dials of such a wire lock is rotated to its opening number, the locking member 17 or 35 should be first withdrawn from the combination lock 10 or 36 and then rewound by the spring biasing force, still causing inconvenience for the lock user.

2. It does not provide any mechanism for resetting a combination in the lock. It is therefore quite inconvenient for changing a lock combination since the lock must be disassembled and then reset a new combination.

The present inventor has found the drawbacks of a conventional wire lock and invented the present wire lock having wire automatically retracted into a lock casing when opening the lock.

SUMMARY OF THE INVENTION

The object of the present invention is to provide a wire lock having a push button latch operatively locking a locking head of a wire rope wound in a lock casing, and operatively depressed for disengaging the locking head of the wire rope when opening the lock so that the wire rope can be automatically retracted into the lock casing.

Another object of the present invention is to provide a wire lock having means for resetting a combination for the wire lock by merely depressing a locking head of the wire rope to disengage the sleeves from the dials for free rotating the dials and for changing a new combination therefor.

DETAILED DESCRIPTION

Figure 2:
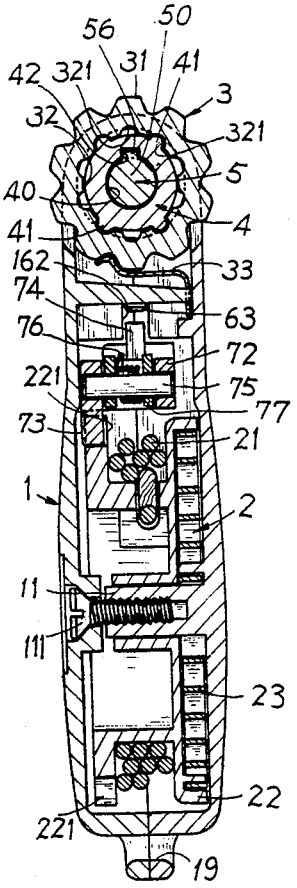
FIG. 2 is a side view sectional drawing of the present invention.

As shown in the figures, the present invention comprises: a casing 1, a wire means 2, a plurality of dials 3, a plurality of sleeves 4, a push-button latch 5, a resilient impinger 6, and a wire clutch means 7.

The casing 1 as comprised of two side walls includes: a spindle 11 formed on a lower central portion of the casing for rotatably mounting the wire means 2 and for combining the two side walls for forming the casing 1 by a screw 111, a right vertical hole 12 having a tapered conical surface 121, a left vertical hole 13, a horizontal latch hole 14 transversely formed in an upper portion of the casing 1 communicated with the two holes 12, 13 having a left side opening, a sliding block 15 slidably held in a right portion in the horizontal hole 14, a U-shaped impinger seat 16 formed on an upper left portion for resiliently holding the impinger 6, a left pin 17 formed on a lower left portion of the casing 1 for pivotally mounting a lower push button 71, a button hole 18 formed in a lower left portion, and a collar 19 formed on a lowest portion of the casing 1 adapted to be connected with other wire locks by a chain or a rope for handling use.

Figure 1:
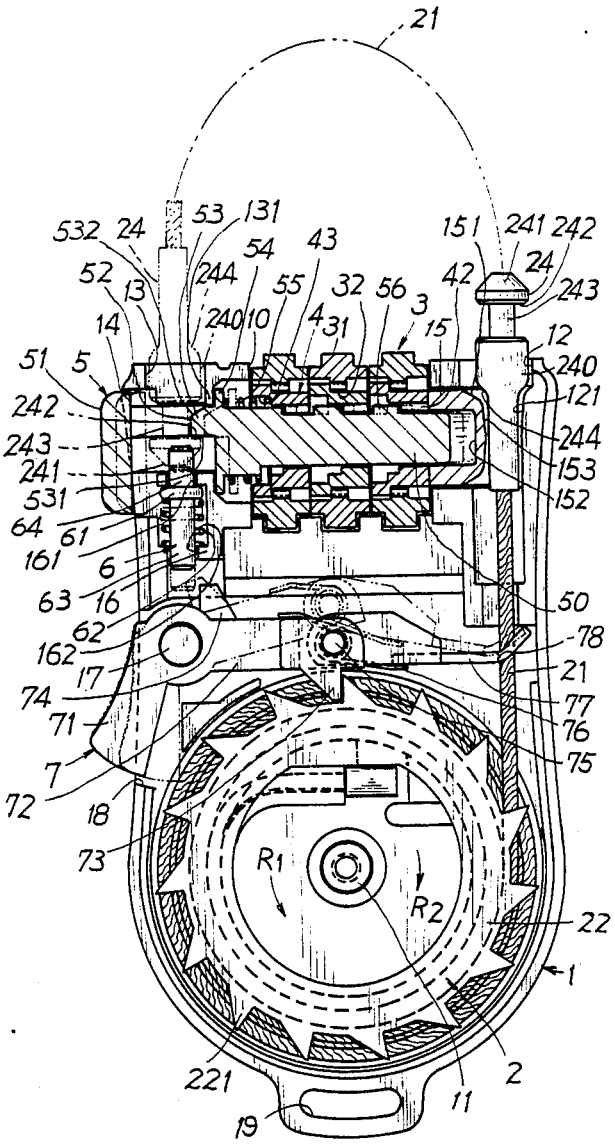
FIG. 1 is a front view sectional drawing of the present invention.

The wire means 2 includes: a wire rope 21 wound on a reel 22 rotatably mounted on the spindle 11, a coil spring 23 resiliently rewinding the wire rope 21 on the reel 22, and a locking head 24 secured to an outermost end of the wire rope 21. The reel 22 includes a plurality of ratchet teeth 221 circumferentially formed on a periphery of a reel disk slidably slipping from a pawl 73 of the wire clutch means 7 when the reel 22 is rotated clockwise R2, and operatively retarded by the pawl 73 when rotated counter-clockwise R1 as shown in FIG. 1.

Figure 3:
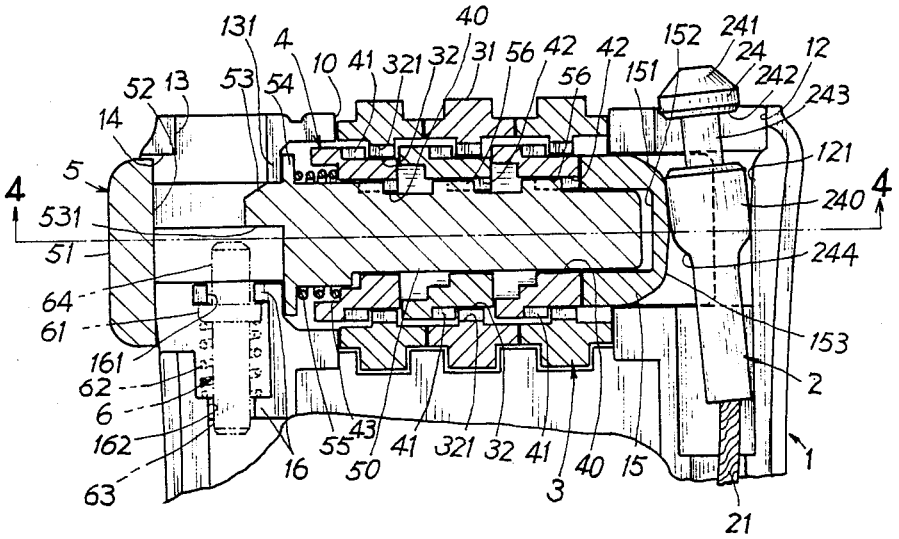
FIG. 3 is an illustration showing the change of a combination of the present invention.

The locking head 24 includes: a truncated cone portion 241 having an upper tapered conical surface, a neck portio 243 pertaining the truncated cone portion 241 and recessed from the cone portion 241 to form a recess 242 (the neck portion 243 being smaller in diameter than the cone portio 241), and a cylindrical portion 240 secured to the neck portion 243 having a lower tapered surface 244 circumferentially formed on a lower portion of the cylindrical portion 240. The lower tapered surface 244 is tangentially engageable with an upper inclined surface 151 of the sliding block 15 so as to thrust the block 15 and the sleeve 4 adjacent to the block 15 leftwardly as shown in FIG. 3. The locking head 24 is secured to the wire rope 21. The cylindrical portion 240 has a diameter generally equal to a diameter of the truncated cone portion 241.

Each dial 3 includes an outer annular ring 31 having a plurality of numbers 0, 1, 2 . . . 9 circumferentially formed on the ring 31, and an inner hole 32 having a plurality of grooves 321 annularly formed in a bore of the hole 32 each groove 321 engageable with a tooth 41 of the sleeve 4.

Each sleeve 4 includes: a plurality of teeth 41 circumferentially formed on a periphery of the sleeve 4, a central hole 40 for slidably engaging a cylindrical rod 50 of the latch 5, a recess 42 recessed in the central hole 40 engageable with a key 56 protruding from the cylindrical rod 50, and a spring socket 43 for retaining a restoring spring 55 therein.

Figure 4:
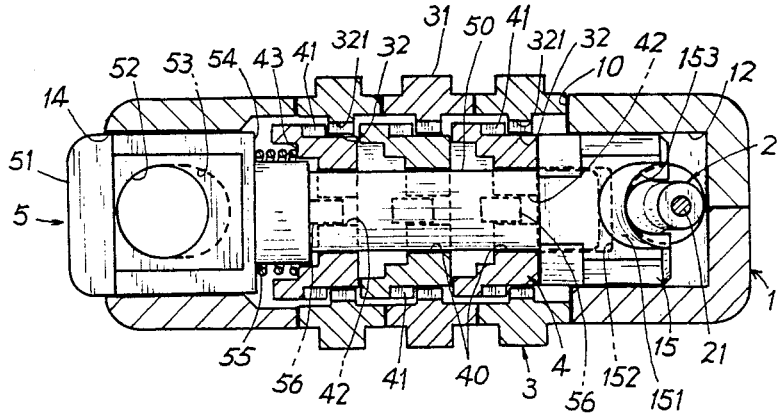
FIG. 4 is a cross sectional drawing of the present invention when viewed from 4—4 direction of FIG. 3.

The push-button latch 5 includes: a push button 51 formed on a left portion of the latch 5, a vertical hole 52 formed in a left portion of the latch 5 slightly larger than the locking head 24 for inserting the truncated cone portion 241 therethrough, a locking extension 53 formed ona right bore portion of the vertical hole 52 having a right-angle corner portion 531 formed on a lower portion of the extension 53 for operatively engaging a recess 242 formed in the locking head 24 for locking the head 24 as shown in dotted line of FIG. 1 and an upper inclined surface 532 formed on an upper bore portion of the hole 52 operatively depressed by the truncated cone portion 241 of the locking head 24, a retaining plate 54 formed on a right side of the extension 53 positioned on an upper left portion of the casing 1 to be urged by a left end of a restoring spring 55 against a wall plate 131 of the vertical hole 13, and a cylindrical rod 50 formed on a right portion of the latch 5 slidably engageable with a central hole 40 of the sleeve 4 having a right outermost end of the rod 50 poking into a recess 152 of the sliding block 15. The sliding block 15 as shown in FIG. 4 is formed with an arcuate notch 153 for clamping the locking head 24 when stored in the right hole 12.

The restoring spring 55 as jacketed on a left portion of the latch 5 has its left end urging the retaining plate 54 and the push button 51 leftwardly and has its right end urging the spring socket 43 of each sleeve 4 rightwardly as shown in FIG. 1 so that each sleeve 4 may not be retarded by each protrusion 56 formed on the cylindrical rod 50 of the latch 5 for a free rotation of each dial 3 coupled with each sleeve 4.

The resilient impinger 6 generally formed as a vertical rod includes: an upper rod portion 64 slidably held in an upper bracket having an upper rod hole 161 of the U-shaped impinger seat 16 and normally protruding upwardly for urging the locking head 24 outwardly, a lower rod portion 63 slidably held in a lower bracket having a lower rod hole 162 of the seat 16, a central ring 61 protruding from a periphery of the impinger rod and defined between the upper rod portion 64 and the lower rod portion 63, and a tensioning spring 62 jacketed on the lower rod portion 63 having its upper end normally urging the ring 61 and upper portion 64 upwardly and having a lower end of the spring 62 retained on the lower bracket of the seat 16.

The wire clutch mean 7 includes: a clutch button 71 pivotally secured in a button hole 78 by a pin 17, a left lever 72 pertaining to the button 71 and protruding rightwardly in a central portion in the casing 1, a pawl 73 protruding downwardly from the left lever 72 for slidingly engaging the ratchet teeth 221 of the wire reel 22, a locking lug 74 protruding upwardly from the lever 72 to be retarded by the lower rod portion 63 of the impinger 6 when the wire lock is locked as shown in dotted line of FIG. 1, a right lever 77 having a right end formed as a bifurcate portion 78 for resiliently straightening the wire rope 21 within the casing 1, a lever pin 73 formed in a central portion of the casing for pivotally connecting the left lever 72 and the right lever 77, and a leveling restoring spring 76 retained on the pin 75 for levelling the two levers 72, 77 for normally engaging the pawl 73 with the ratchet teeth 221 and for resiliently urging and straightening the wire rope 21.

When using the present invention for locking purpose, the locking head 24 of the wire means 2 is pulled leftwardly as shown in FIG. 1 to be inserted through the left hole 13, the tapered surface of the truncated jcone portion 241 may thrust the upper inclined surface 532 of the extension 53 to urge the latch 5 rightwardly and to depress the impinger 6 downwardly when the dials 3 are rotated to their opening combination. When the cone portion 241 is slipping to pass the extension 53, the restoring spring 55 will urge the extension 53 leftwardly to engage the recess 242 at the neck portion 243 of the locking head 24, and the dials 3 are rotated to a close condition to deviate each recess 42 of the sleeve 4 from the protrusion 56 of the latch 5 so that even a depression of the push button 51 the latch 5 is not retracted rightwardly as obstructed by each sleeve 4 for locking the wire lock. At this moment, the lower rod portion 63 of the impinger 6 also retards a leftward movement of the upper lug 74 to lock the depression of the clutch button 71 so that the ratchet teeth 221 of the wire means 2 are locked by the pawl 73 for stopping the rotation R1 of reel 22 without releasing the wire rope 21 for a real locking situation.

For opening the wire lock of the present invention, the dials are rotated to an opening combination to allow each recess 42 of each sleeve 4 to engage each protrusion 56 of the latch 5 as shown in FIG. 2, whereby upon a depression of the push button 51 to retract the extension 53 of the latch 5 rightwardly to disengage the locking head 24, the impinger 6 as urged by the spring 62 will resiliently eject the locking head 24 upwardly beyond the hole 13 and the coil spring 23 of the wire means 2 will rewind the wire rope 21 onto the reel 22 until the wire rope 21 is withdrawn rightwardly to keep the locking head 24 in the right hole 12. During the rewinding of the wire rope in direction R2 as shown in FIG. 1, the ratchet teeth 221 are rotatably slipping from the pawl 73 for a rotation of the reel 22 for retracting the wire rope 21 within the casing 1. If for further pulling the wire rope 21 outwardly from the casing 1, the clutch button 71 is depressed to bias the lever 72 upwardly to disengage the pawl 73 from the ratchet teeth 221 as shown in dotted line of FIG. 1 and upon a pulling of the locking head 24 and wire rope 21 outwardly, the reel 22 will be free rotated in direction R1 without being locked by the pawl 73.

For resetting a new combination of the present invention as shown in FIGS. 3, 4, the locking head 24 is depressed downwardly to allow its lower inclined surface 244 to tangentially thrust the inclined surface 151 of the sliding block 15 leftwardly so as to disengage the teeth 41 of sleeve 4 from the grooves 321 of dial 3 for free rotation of dials 3 for resetting a new combination. The leftward movement of sleeves 4 will cause the recess 42 in each sleeve 4 to be engaged with each protrusion 56 of the latch 5 so that during a resetting rotation of the dials 3, the sleeves 4 can be firmly held by the latch 5 which is also stably urged by a depression of the locking head 24. After finishing the resetting operation, the locking head 24 is slightly pulled for free rotating the dials to a close combination.

The present invention is superior to the conventional wire lock with the advantages of: a quicker ejection and a self-retraction of a wire rope when opening the lock; a convenient resetting operation for changing a new combination and a simple mechanism for resetting the combination.

I claim:

1. A wire lock comprising:

a casing composed of two side walls having a left vertical hole and a right vertical hole formed in two upper sides of said casing;

a wire means including a wire rope normally resiliently wound on a reel pivotally secured in said casing, a locking head formed on an outermost end of said wire rope operatively inserted in said left vertical hole for locking said wire rope in said casing and retractably held in said right vertical hole when opening the wire lock;

a plurality of dials respectively coupled with a plurality of sleeves rotatably mounted on a push-button latch formed on an upper portion of said casing;

said push-button latch having a push button formed on its left portion normally protruding leftwardly beyond said casing and having a cylindrical rod formed on a right portion of the latch for rotatably securing said sleeves and dials thereon, having a locking extension formed on a left portion of said latch operatively engageable with said locking head of said wire means for locking the wire lock;

a resilient impinger generally formed as a vertical rod resiliently protruding upwardly to operatively urge said locking head upwardly outwardly beyond said casing when opening the wire lock;

and a wire clutch means controlling a rewinding of said wire rope on said reel of said wire means or a releasing of said wire rope unwound from said reel.

2. A wire lock according to claim 1, wherein said locking head of said wire means includes a truncated cone portion having a first tapered conical surface, a neck portion recessed from said truncated cone portion, and a cylindrical portion secured to said wire rope pertaining the neck portion, said first tapered conical surface tangentially engageable with and rightwardly retracting an upper inclined surface formed on said locking extension of said latch when inserting said locking head into said left hole in said casing, said truncated cone portion having a recess engageable with said locking extension of said latch for locking the wire lock when leftwardly extending said locking extension.

3. A wire lock according to claim 2, wherein said truncated cone portion of said locking head has a diameter equal to a diameter of said cylindrical portion of said locking head.

4. A wire lock according to claim 1, wherein each said sleeve includes a central hole slidably engageable with a cylindrical rod of said latch and a recess recessed in said central hole slidably engageable with a protrusion protruding on said cylindrical rod of said latch, and a spring socket for retaining a restoring spring therein, said restoring spring jacketed ona left portion of said latch having a left end of said restoring spring urging said push button leftwardly and having a right end of said spring urging said spring socket of said sleeve for resiliently coupling said sleeves with said dials.

5. A wire lock according to claim 1, wherein said push-button latch is formed with a vertical hole slightly larger than a diameter of said locking head in its left portion communicated with the left vertical hole of said casing, said locking extension of said latch formed on a right bore portion of said vertical hole for operatively engaging said locking head of said wire means.

6. A wire lock according to claim 1, wherein said resilient impinger generally formed as a vertical rod includes an upper rod portion slidably held in an upper bracket of a U-shaped impinger seat formed on a left portion of said casing, a lower rod portion slidably held in a lower bracket of said U-shaped impinger seat, a central ring annularly formed on the vertical rod between the upper and lower rod portions, and a tensioning spring retained between the central ring and the lower bracket normally urging a truncated cone portion of said locking head upwardly.

7. A wire lock according to claim 1, wherein said locking head of said wire means is formed with a second tapered conical surface between a cylindrical portion and said wire rope secured with said locking head for being tangentially engageable with an inclined surface formed on a sliding block slidably held in a latch hole in said casing between said sleeves and said locking head, said sliding block having a recess for operatively receiving a right end of said latch, whereby upon a downward depression of said locking head when kept in said right vertical hole in said casing, said second tapered conical surface will thrust said sliding block leftwardly to disengage the sleeves from the dials for free rotation of the dials for resetting a new combination.

8. A wire lock according to claim 1, wherein said wire clutch means includes a clutch button pivotally mounted on a lower left portion of said casing, a left lever pertaining with said clutch button having a pawl protruding downwardly to operatively engage a plurality of ratchet teeth formed on said reel for winding the wire rope thereon for locking the wire rope and having an upper lug protruding upwardly from the left lever operatively retarded by a lower rod portion of said resilient impinger when locking the wire lock, a right lever pivotally secured with said left lever by a pin, and a levelling restoring spring jacketed on the pin for normally levelling the two levers for engageably locking said ratchet teeth of said wire rope without releasing the wire rope.

9. A wire lock according to claim 8, wherein said right lever of said wire clutch means is formed with a bifurcate portion for resiliently clamping said wire rope in said casing.

10. A wire lock according to claim 1, wherein said pushbutton latch is slidably held in an upper hole horizontally formed in an upper portion of said casing.

11. A wire lock according to claim 1, wherein said push-button latch further includes a retaining plate formed on a left portion of said latch adjacent to said locking extension resiliently retained by a restoring spring jacketed on said latch for urging said push button of said latch leftwardly outwardly beyond said casing.

12. A wire lock according to claim 1, wherein said casing is formed with a collar thereon so that plural wire locks can be connected in series by a chain.

* * * * *